US005738382A

United States Patent [19]

Grosskopf et al.

[11] Patent Number: 5,738,382

[45] Date of Patent: Apr. 14, 1998

[54] LAMINATED PACKAGE LABEL

[75] Inventors: Glenn A. Grosskopf, Lake Zurich, Ill.; Carl W. Treleaven, Greensboro, N.C.

[73] Assignees: Pharmagraphics (Midwest), L.L.C.; Pharmagraphics (Southeast), L.L.C., both of Greensboro, N.C.

[21] Appl. No.: 598,799

[22] Filed: Feb. 9, 1996

[51] Int. Cl.[6] ..... B42D 15/00

[52] U.S. Cl. ..... 283/81; 283/40.1

[58] Field of Search ..... 283/81, 51, 49, 283/56, 903, 106, 100, 94; 428/40.1, 41.7, 41.8, 41.9, 42.1, 94, 914; 40/310, 638, 630; 462/900, 901

[56] References Cited

U.S. PATENT DOCUMENTS

| | | | |
|---|---|---|---|
| Re. 34,366 | 9/1993 | Instance | 283/81 |
| 4,529,229 | 7/1985 | Glibbery | 283/81 |
| 4,534,582 | 8/1985 | Howard | 283/81 |
| 4,621,442 | 11/1986 | Mack | 40/2 R |
| 4,621,837 | 11/1986 | Mack | 283/105 |
| 4,711,686 | 12/1987 | Instance | 156/227 |
| 4,930,812 | 6/1990 | Howard | 462/901 |
| 4,933,043 | 6/1990 | Instance | 156/248 |
| 4,955,640 | 9/1990 | Anderson | 283/106 |
| 5,074,595 | 12/1991 | Hill et al. | 283/81 |
| 5,127,676 | 7/1992 | Bockario | 283/81 |
| 5,207,458 | 5/1993 | Treichel et al. | 283/81 |
| 5,207,746 | 5/1993 | Jones | 283/81 |
| 5,234,735 | 8/1993 | Baker et al. | 428/40 |
| 5,262,214 | 11/1993 | Instance | 428/40 |
| 5,263,743 | 11/1993 | Jones | 283/81 |
| 5,286,062 | 2/1994 | Greenwood et al. | 283/106 |
| 5,308,119 | 5/1994 | Roshkoff | 283/81 |
| 5,403,636 | 4/1995 | Crum | 428/40 |
| 5,449,538 | 9/1995 | Denny | 428/41.8 |
| 5,605,730 | 2/1997 | Trelevan | 428/40.1 |

*Primary Examiner*—Willmon Fridie, Jr.

*Attorney, Agent, or Firm*—Myers Bigel Sibley & Sajovec, P.A.

[57] ABSTRACT

The present invention is directed to a label for displaying information regarding a package. The label includes a bottom panel, a top panel overlying and connected to said bottom panel along a first fold line, and at least one interior panel connected to one of the bottom panel and the top panel along a second fold line. An adhesive layer is disposed on the lower surface of the bottom panel. Each of the bottom panel and the top panel have a marginal portion extending between the first fold line and an adjacent edge of the interior panel. An access tear line is formed in the marginal portion of the top panel. Preferably a second access tear line is formed in the marginal portion of the top panel and spaced apart from the first access tear line, defining a tear strip therebetween. A marginal extended flap may extend from one of the top and bottom panels. The label may further include a laminate cover overlying the top panel.

33 Claims, 5 Drawing Sheets

LAMINATED PACKAGE LABEL

FIELD OF THE INVENTION

The present invention is directed to an extended text label, and, more particularly, to an extended text label for pharmaceutical and like uses having multiple panels including a base panel, a marginal portion, a laminate cover, and means to access and selectively detach and remove the laminate cover and further panels from the label.

BACKGROUND OF THE INVENTION

In the packaging of certain chemicals and pharmaceuticals, the manufacturer is often required or desires to provide a considerable amount of information concerning the chemical or pharmaceutical. In the case of pharmaceuticals, this is required by government regulations, however, the occasion may also arise, either separate from or in conjunction with government regulations, to provide the doctor, pharmacist or user with instructions on how the product should be used, what the product is, and safety precautions which should be followed in the use of the product. Sometimes the literature, which is generally in the form of folded leaflets, is placed within a box along with the container carrying the chemical or pharmaceutical (referred to as "inserts"). The placement of leaflets within the box is expensive and a cumbersome operation to perform. Also, it is difficult to insure by later inspection that the proper literature has been inserted in the proper package. Most all products are packaged in outer cartons and many are not compatible with inserts. Further, the use of folded cartons is under scrutiny by environmental groups, as involving excessive packaging. In an effort to meet this challenge, many companies are looking at ways to eliminate folding cartons that carry containers inside.

A different approach to solving this problem has developed over the last several years in which the folded literature is releasably attached to the face of the container (referred to as "outserts"), either directly to the container itself, or to a base label which, in turn, is secured to the container. The literature may then be removed by the customer. In such cases, the portion of the label remaining must carry both an "identification" of the product, for example, information such as trademark, manufacturer, etc., as well as certain "statutory information" (for example, lot number and expiration date).

Thus, in order to meet the objectives of such labeling techniques, certain criteria must be met. First of all, the portion of the label which remains after the folded literature product is removed must contain both the identification of the product, as well as the statutory information concerning the lot number, and expiration date. Further, after the literature leaflet is assembled or affixed to the base label, the indicated area for statutory information concerning lot number and expiration date must be accessible for stamping or printing by the pharmaceutical company and visible to the consumer in addition to the identification of the product. The folded leaflet portion remains affixed to the label portion until the customer (doctor, pharmacist, consumer) desires its removal. It is critical that the proper literature must be affixed to the proper base label. Finally, all of the above criteria must be accomplished in a manufacturing technique that insures quality and is cost-effective.

Examples of labels designed to eliminate the separate base panel are disclosed in U.S. Pat. Nos. 5,207,746 and 5,263,743, each to Jones. While the Jones labels and similar known label constructions are well suited for many applications, they suffer from certain significant drawbacks and limitations in manufacture, application, and functionality.

Preferably, the labels are provided as a web comprising a succession of labels disposed on a release liner. It is often desirable to manufacture the labels using "multiple up" books. That is, multiple up books consisting of two or more leaflets each are applied to a wide web. The multiple up books are thereafter die cut to form the individual leaflets with strips of waste material disposed between the leaflets of each multiple up book. If the leaflets are directly adhered to the release liner by an adhesive layer, as in the case of the Jones labels, then special provision must be made for removal of the waste portions. Such special provision, if feasible, is typically cumbersome and adds time and expense to the manufacture of the labels. Further, in manufacturing Jones type labels, the die cuts for forming tear lines for removal of selected panels must be accurately placed to avoid cutting through adjacent folds where tear lines are not intended.

When applying leaflets according to the Jones designs to containers, there is occasionally a tendency for the leaflet to lodge against or hang up on the applicator as it is transferred across turn bars and the like. Further, because only a relatively narrow strip of adhesive may feasibly be provided to hold closed the leaflet disclosed in U.S. Pat. No. 5,207,746 to Jones, there exists a substantial risk of the label becoming unfolded during application.

After a label according to either design has been applied to a container, the paper stock from which the label is formed may be subjected to tearing and/or abrasive forces, for example when the container is dropped into a packing crate. The label may be torn to the extent that it is allowed to unfold prematurely.

The Jones type labels and many similar labels require a certain degree of dexterity on the part of the end user in order to open the labels. Also, once the label has been opened, the panels other than the base panel must be removed or otherwise allowed to dangle from the container. In many applications it is preferable that the user have the option of reclosing the label.

Thus, there exists a need for a multiple panel package label which resists tearing and abrasion. There exists a need for such a package label which has greater integrity. Further, there exists a need for a package label which allows for resealability and provides easy access to the multiple panels thereof. There exists a need for a package label as described above which may be efficiently and cost effectively manufactured, and, particularly, which lends itself to manufacture using multiple up books.

SUMMARY OF THE INVENTION

The present invention is directed to a label for displaying information regarding a package. The label includes a bottom panel having an upper surface and a lower surface and a top panel overlying and connected to the bottom panel along a first fold line. At least one interior panel is connected to one of the bottom panel and the top panel along a second fold line. An adhesive layer is disposed on the lower surface of the bottom panel. Each of the bottom panel and the top panel have a marginal portion extending between the first fold line and an adjacent edge of the interior panel, the marginal portion of the top panel overlying the marginal portion of the bottom panel. An access tear line is formed in the marginal portion of the top panel. The label may further include a laminate cover overlying the top panel and secured to the top panel by a laminate adhesive. The laminate cover has a laminate tear line formed therein overlying the access tear line.

The above described label may further include a second access tear line formed in the marginal portion of the top panel and spaced apart from the first access tear line. The first and second access tear lines define a tear strip therebetween. Further, a laminate cover as described above may be provided having first and second laminate tear lines formed therein overlying the first and second access tear lines, respectively.

The present invention is further directed to a label for displaying information regarding a package having a bottom panel having an upper surface and a lower surface, a top panel overlying and connected to the bottom panel along a first fold line, and at least one interior panel connected to one of the top and bottom panels as described above. A marginal extended flap extends from the other of the bottom panel and the top panel, (That is, where the interior panel is connected to the top panel, the marginal extended flap will extend from the bottom panel, and where the interior panel is connected to the bottom panel, the marginal extended flap will extend from the top panel.) the marginal extended flap having an upper surface and a lower surface. An adhesive layer is disposed on the lower surface of the bottom panel and the lower surface of the marginal extended flap for securing the label to the package. Each of the bottom panel and the top panel have a marginal portion extending between the first fold line and an adjacent edge of the interior panel, the marginal portion of the top panel overlying the marginal portion of the bottom panel. A laminate cover overlies the top panel and the marginal extended flap and is secured to the top panel and the marginal extended flap by a laminate adhesive. First and second access tear lines are formed in the marginal portion of the top panel and spaced apart from one another, the first and second access tear lines defining a tear strip therebetween. First and second laminate tear lines are formed in the laminate cover overlying the first and second access tear lines, respectively. A removal tear line is disposed adjacent the second fold line. Indicia is disposed on the upper surface of the marginal extended flap and corresponding indicia is disposed on the upper surface of the bottom panel. The aforedescribed label may further including a third laminate tear line formed in the laminate cover adjacent the marginal extended flap. The laminate cover may be releasably and resealably secured to the upper surface of the marginal extended flap by the laminate adhesive.

In a first more particular embodiment, a label for displaying information regarding a package includes a bottom panel and a top panel connected along a first fold line as described above. At least one interior panel is connected to the top panel along a second fold line. The bottom panel includes a marginal extended flap extending beyond the top panel. The label further includes an adhesive layer and a laminate cover as described above. Each of the bottom panel and the top panel have a marginal portion extending between the first fold line and an adjacent edge of the interior panel, the marginal portion of the top panel overlying the marginal portion of the bottom panel. An access tear line is formed in the marginal portion of the top panel. A laminate tear line is formed in the laminate cover overlying the access tear line.

In a label as just described, a second laminate tear line may be formed in the laminate cover adjacent the marginal extended flap. The laminate cover may be releasably and resealably secured to the upper surface of the marginal extended flap by the laminate adhesive. A second access tear line may be formed in the marginal portion of the top panel and spaced apart from the first access tear line, the first and second access tear lines defining a tear strip therebetween. Preferably, a further laminate tear line overlies the second access tear line. A removal tear line may be provided in one of the top panel and the interior panel adjacent the second fold line. Preferably, the adhesive layer extends continuously from at least the first fold line to the marginal extended flap. Indicia may be disposed on the upper surface of the marginal extended flap with corresponding indicia disposed on the upper surface of the bottom panel.

In a second more particular embodiment, a label for displaying information regarding a package includes a bottom panel and a top panel connected along a first fold line as described above. At least one interior panel is connected to the bottom panel along a second fold line. A marginal extended flap extends from the top panel. The label further includes an adhesive layer and a laminate cover as described above. Each of the bottom panel and the top panel have a marginal portion extending between the first fold line and an adjacent edge of the interior panel, the marginal portion of the top panel overlying the marginal portion of the bottom panel. An access tear line is formed in the marginal portion of the top panel. A laminate tear line is formed in the laminate cover overlying the access tear line.

In the second more particular embodiment, a removal tear line may be formed in the top panel adjacent the marginal extended flap and the second fold line with a further laminate tear line formed in the laminate cover and overlying the removal tear line. A second access tear line may be formed in the marginal portion of the top panel and spaced apart from the first access tear line, the first and second access tear lines defining a tear strip therebetween. The label may further include a second laminate tear line overlying the second access tear line. Preferably, the adhesive layer extends continuously from at least the first fold line to the marginal extended flap. Indicia may be disposed on the upper surface of the marginal extended flap with corresponding indicia disposed on the upper surface of the bottom panel.

The present invention is further directed to a label for displaying information regarding a package including a bottom panel having an upper surface and a lower surface and a top panel overlying and connected to the bottom panel along a first fold line. At least one interior panel is connected to the top panel along a second fold line. The bottom panel includes a marginal extended flap extending beyond the top panel, the marginal extended flap having an upper surface and a lower surface. An adhesive layer is disposed on the lower surface of the bottom panel and the lower surface of the marginal extended flap for securing the label to the package. A laminate cover overlies the top panel and the marginal extended flap and is secured to the top panel and the marginal extended flap by a laminate adhesive. An access tear line is formed in the top panel adjacent the first fold line. A laminate tear line is formed in the laminate cover overlying the access tear line.

In a label as just described, a second laminate tear line may be formed in the laminate cover adjacent the marginal extended flap. The laminate cover may be releasably and resealably secured to the upper surface of the marginal extended flap by the laminate adhesive. A second access tear line may be formed in the top panel and spaced apart from the first access tear line, the first and second access tear lines defining a tear strip therebetween. Preferably, a further laminate tear line overlies the second access tear line. A removal tear line may be provided in one of the top panel and the interior panel adjacent the second fold line.

Preferably, the adhesive layer extends continuously from at least the first fold line to the marginal extended flap. Indicia may be disposed on the upper surface of the marginal extended flap with corresponding indicia disposed on the upper surface of the bottom panel.

The present invention is further directed to a label for displaying information regarding a package including a bottom panel having an upper surface and a lower surface and a top panel overlying and connected to the bottom panel along a first fold line. At least one interior panel is connected to the bottom panel along a second fold line. A marginal extended flap extends from the top panel, the marginal extended flap having an upper surface and a lower surface. An adhesive layer is disposed on the lower surface of the bottom panel and the lower surface of the marginal extended flap for securing the label to the package. A laminate cover overlies the top panel and the marginal extended flap and is secured to the top panel and the marginal extended flap by a laminate adhesive. An access tear line is formed in the top panel adjacent the first fold line and a laminate tear line is formed in the laminate cover overlying the access tear line.

In the label as just described, a removal tear line may be formed in the top panel adjacent the marginal extended flap and the second fold line with a further laminate tear line formed in the laminate cover and overlying the removal tear line. A second access tear line may be formed in the top panel and spaced apart from the first access tear line, the first and second access tear lines defining a tear strip therebetween. The label may further include a second laminate tear line overlying the second access tear line. Preferably, the adhesive layer extends continuously from at least the first fold line to the marginal extended flap. Indicia may be disposed on the upper surface of the marginal extended flap with corresponding indicia disposed on the upper surface of the bottom panel.

An object of the present invention is to provide a multiple panel package label which resists tearing and abrasion.

An object of the present invention is to provide such a package label which has enhanced integrity.

A further object of the present invention is to provide a multiple panel package label which allows for resealability.

A further object of the present invention is to provide a multiple panel label which provides easy access to the information on the multiple panels. In particular, it is an object of the present invention to provide such a label which allows a significant margin of error in manufacture.

An object of the present invention is to provide a label in which the printed components thereof may be formed from a unitary construction, thereby eliminating the risk of mismatching such components.

An object of the present invention is to provide a label the back side of which may be printed on, such printing being visible, for example, though a clear container to which the label has been adhered by its back side.

Yet another object of the present invention is to provide a package label as described above which may be efficiently and cost effectively manufactured. In particular, an object of the present invention is to provide a package label as described above which lends itself to manufacture using multiple up books.

The preceding and further objects of the present invention will be appreciated by those of ordinary skill in the art from a reading of the figures and the detailed description of the preferred embodiment which follow, such description being merely illustrative of the present invention.

DETAILED DESCRIPTION OF THE PREFERRED EMBODIMENTS

Figure 1:
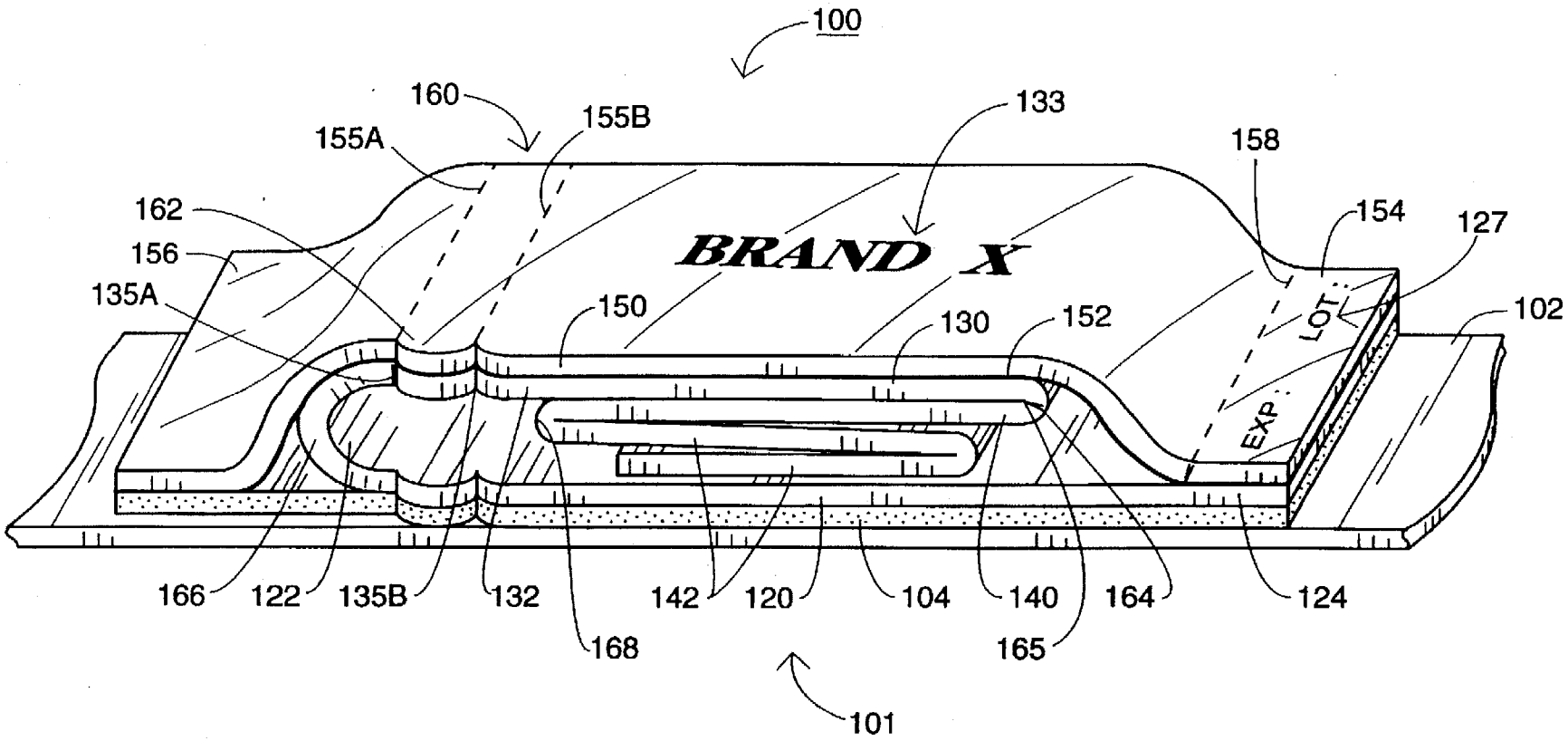
FIG. 1 is a perspective view of a label according to a first embodiment of the present invention disposed on a release liner.
Figure 3:
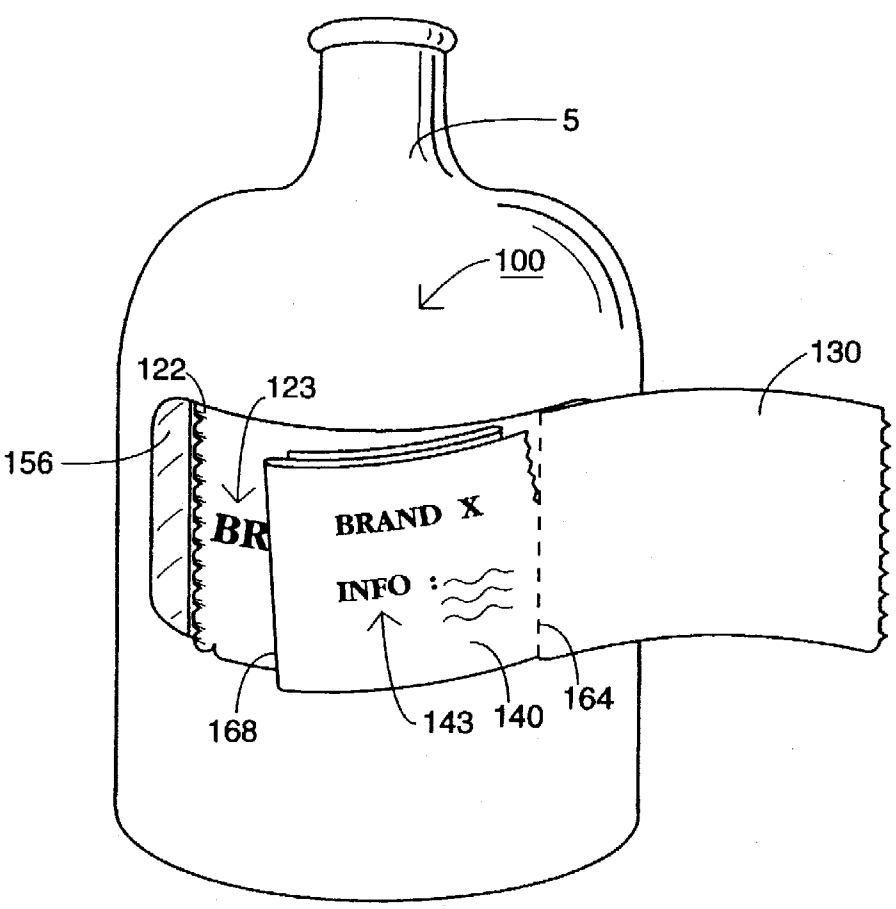
FIG. 3 is a perspective view of the label of the first embodiment secured to a container, the tear strip being completely removed and the first interior panel thereof partially removed.
Figure 2:
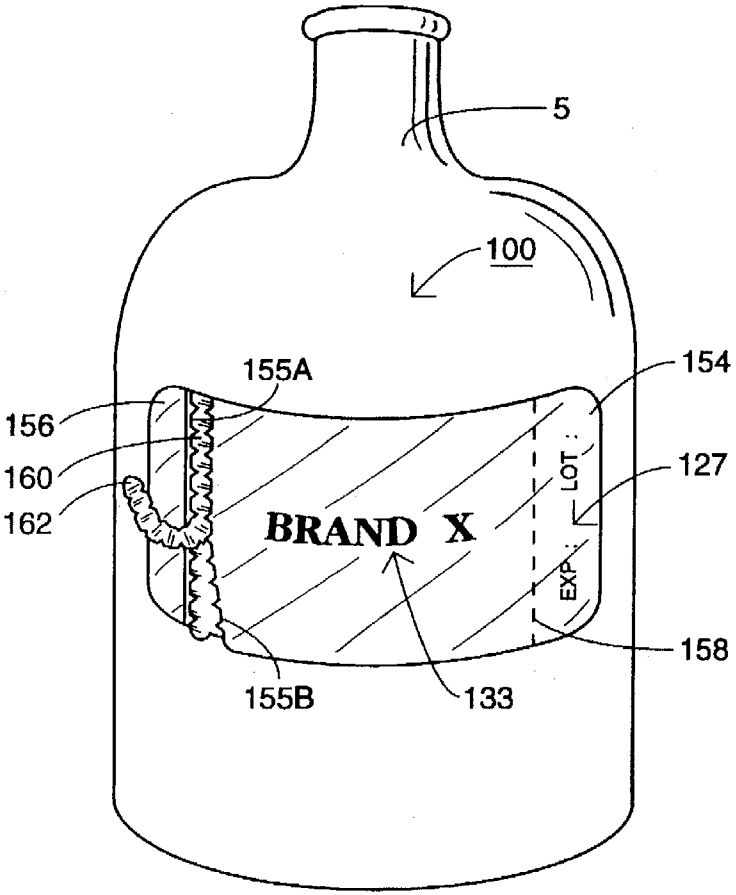
FIG. 2 is a perspective view of the label of the first embodiment secured to a container, the tear strip thereof being partially removed.

With reference to FIGS. 1–3, a label according to a first embodiment of the present invention, generally denoted by the numeral 100, is shown therein. Label 100 includes leaflet 101 and laminate cover 150. Label 100 is releasably secured to release liner 102 by adhesive layer 104. Adhesive layer 104 remains with label 100 when it is removed from release liner 102 and serves to secure label 100 to a container 5 (FIGS. 2 and 3). Label 100 includes tear strip 160 and tear lines 158 and 164 which provide for access to and detachment of the various panels of leaflet 101, as discussed in more detail below.

Leaflet 101 includes bottom panel 120, top panel 130, first interior panel 140, and additional interior panels 142. Top panel 130 and bottom panel 120 are joined along fold 166; top panel 130 and first interior panel 140 are joined along the fold 165. Top panel 130 includes parallel, spaced apart tear lines 135A and 135B formed therein. Tear line 164 is formed along fold 165 or, alternatively, in panel 140 adjacent fold 165. Top panel 130 includes marginal portion 132 extending between fold 166 and the adjacent edge 168 of interior panel 140. Bottom panel 120 includes marginal portion 122 extending between fold 166 and adjacent edge 168. Bottom panel 130 further includes marginal extended flap 124 extending outwardly beyond top panel 130. Suitable title indicia 133 is printed on the upper surface of top panel 130. Indicia 127 such as expiration date and lot number are printed on the upper surface of marginal extended flap 124. Indicia 123, preferably substantially identical to indicia 133, is disposed on the upper surface of bottom panel 120. Other suitable indicia 143, for example, instructions and warnings, are printed on panels 140, 142.

Leaflet 101 is preferably formed from a unitary blank of 60 lbs. coated paper or litho stock. Methods and apparatus for forming leaflets 101 will be appreciated by those of ordinary skill in the art upon a reading of the foregoing and the following.

Laminate cover 150 overlies leaflet 101 and is secured thereto by laminate adhesive 152. More particularly, laminate portion 154 is secured to the upper surface of marginal extended flap 124, laminate portion 156 is releasably adhered to release liner 102, and the remainder of laminate cover 150 is secured to the upper surface of top panel 130. Tear lines 155A and 155B are formed in laminate cover 150 overlying tear lines 135A and 135B, respectively, of top panel 130. Tear line 158 is formed in laminate cover 150 preferably adjacent fold 165.

Laminate cover 150 is preferably formed from polypropylene. Suitable laminate materials include, for example, 2 mil polypropylene product no. 04324 available from Madico, Incorporated of Woburn, Mass.

The portion of laminate cover 150 defined between tear lines 155A and 155B and the portion of top panel 130 defined between tear lines 135A and 135B together form tear strip 160. Preferably, label 100 is formed such that tear strip 160 includes tab 162 to facilitate manipulation of the tear strip. Tear strip 160 lies entirely in marginal portion 132 and overlies only marginal portion 122 of bottom panel 120. Marginal portions 122, 132 are preferably from about 0.1875 to about 0.25 inches wide each. Further, tear line 135B is formed from about 0.3125 to about 0.625 inches laterally away from adjacent edge 168.

With reference to FIGS. 2 and 3, a label 100 is shown therein secured to a suitable container 5 by adhesive layer 104. Prior to manipulation by the end user, label 100 is positioned in the closed and sealed position of FIG. 1. In this position, indicia 127 and 133 are visible. When the end user wishes to open label 100 to inspect indicia 123 and/or indicia 143, he or she may do so by grabbing tab 162 and pulling tear strip 160 downwardly and outwardly (as shown in FIG. 2), thereby severing top panel 130 along tear lines 135A, 135B, 155A, and 155B. Thereafter, the end user may fold top panel 130 outwardly as shown in FIG. 3. Once label 100 has been opened as described above, the end user may remove top panel 130 (and the portion of laminate cover 150 adhered thereto) and interior panels 140, 142 by tearing along tear line 158 of laminate cover 150. Alternatively, the end user may remove interior panels 140, 143 by tearing along tear line 164, leaving top panel 130 and the attached portion of laminate cover 150 with container 5.

Figure 6:
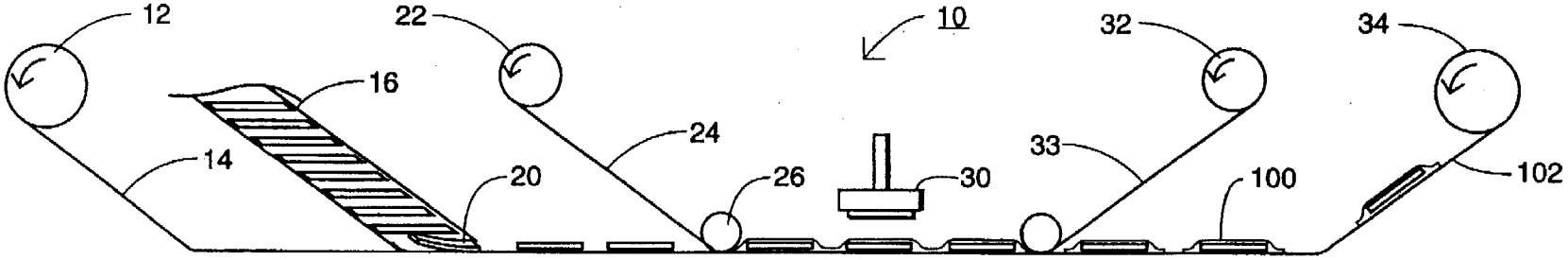
FIG. 6 is a schematic diagram of an apparatus for forming labels according to either the first and second embodiments.

With reference to FIG. 6, an apparatus for forming labels 100 is shown therein. First, a suitable web 14 is supplied from unwind station 12. Web 14 may be a transfer tape such as 3M Product No. 9447, 1 mil High Tenacity Tape with 320 Adhesive. The transfer tape preferably includes release liner 102 having an adhesive layer of pressure sensitive adhesive on the upper surface thereof. Transfer tapes having a second release liner layer located on the adhesive layer may also be used. Alternatively, web 14 may be a release liner to which pressure sensitive adhesive is applied to the upper surface thereof by an adhesive applicator, including just prior to application of each leaflet 20. Alternatively, the adhesive may be applied to the lower surfaces of the leaflets 20.

Alternatively, web 14 may be a double coated tape consisting of release liner 102, a first adhesive layer coating the upper surface of the release liner, a carrier preferably formed from a polymeric material such as polypropylene substrate overlying the first adhesive layer, and a second adhesive layer overlying the carrier. Double coated tape as described may be formed by applying a pressure sensitive adhesive coating to the upper surface of a self adhesive polypropylene substrate disposed on a release liner, such as 3M Scotch Brand Tape Product No. 7214FL 2 mil polypropylene. Double coated tapes having a second release liner layer located on the second adhesive layer may also be used. Double coated tapes having carriers formed from polyester, polystyrene, polyethylene or other polyolefins may be used as well. A suitable product having a polyester carrier is Flexcon Flexmark Product No. DFM-100-Clear V-23/70 D/FK. Notably, if labels are formed form double coated tape as just described, the resulting labels would not appear as described in the first embodiment and the second embodiment (as discussed below), but rather would include an additional adhesive layer and a carrier interposed between the leaflet and the release liner.

As a further alternative, web 14 may be a self adhesive stock web preferably consisting of a web of face stock releasably adhered to a release liner by means of a pressure sensitive adhesive coating. The self adhesive stock web may be, for example, high gloss paper with S246 adhesive available from Fasson. If a self adhesive stock web is used, an adhesive applicator would be provided to apply adhesive to the upper surface of the self adhesive stock web or to the lower surface of the bottom panels prior to application of the leaflets 20 to the web. Notably, if labels are formed using a self adhesive base stock web as just described, the resulting labels will not appear as described in the first embodiment and the second embodiment (as discussed below), but rather would also include a layer of pressure sensitive adhesive and base stock interposed between the release liner or bottle and the bottom panel.

Leaflets 20 are applied to web 14 by leaflet application station 16. Thereafter, self adhesive laminate web 24 is supplied by unwind station 22 and adhered by nip roller 26 and the adhesive thereof over leaflets 20 and web 14. Die cutter station 30 cuts through laminate web 24 forming laminate covers 150. Further, leaflets 20 are cut to form leaflets 101 having tab 162. Each of tear lines 135A, 135B, 155A, 155B, and 158, may be formed by die cut station 30 or a further die cut station. Moreover, tear lines 135A, 135B, and 164 may be formed in leaflet 20 prior to application to the web. Tear lines (not shown) may be formed in the bottom panel underlying tear lines 135A and 135B if desired or to facilitate manufacture. Waste matrix 33 including the portions of laminate web 24 outside laminate covers 150 and the underlying adhesive are removed by winding station 32. The resulting labels 100 carried on release liner 102 may then be collected on a roll by winding station 34 or sheeted and stacked.

Figure 4:
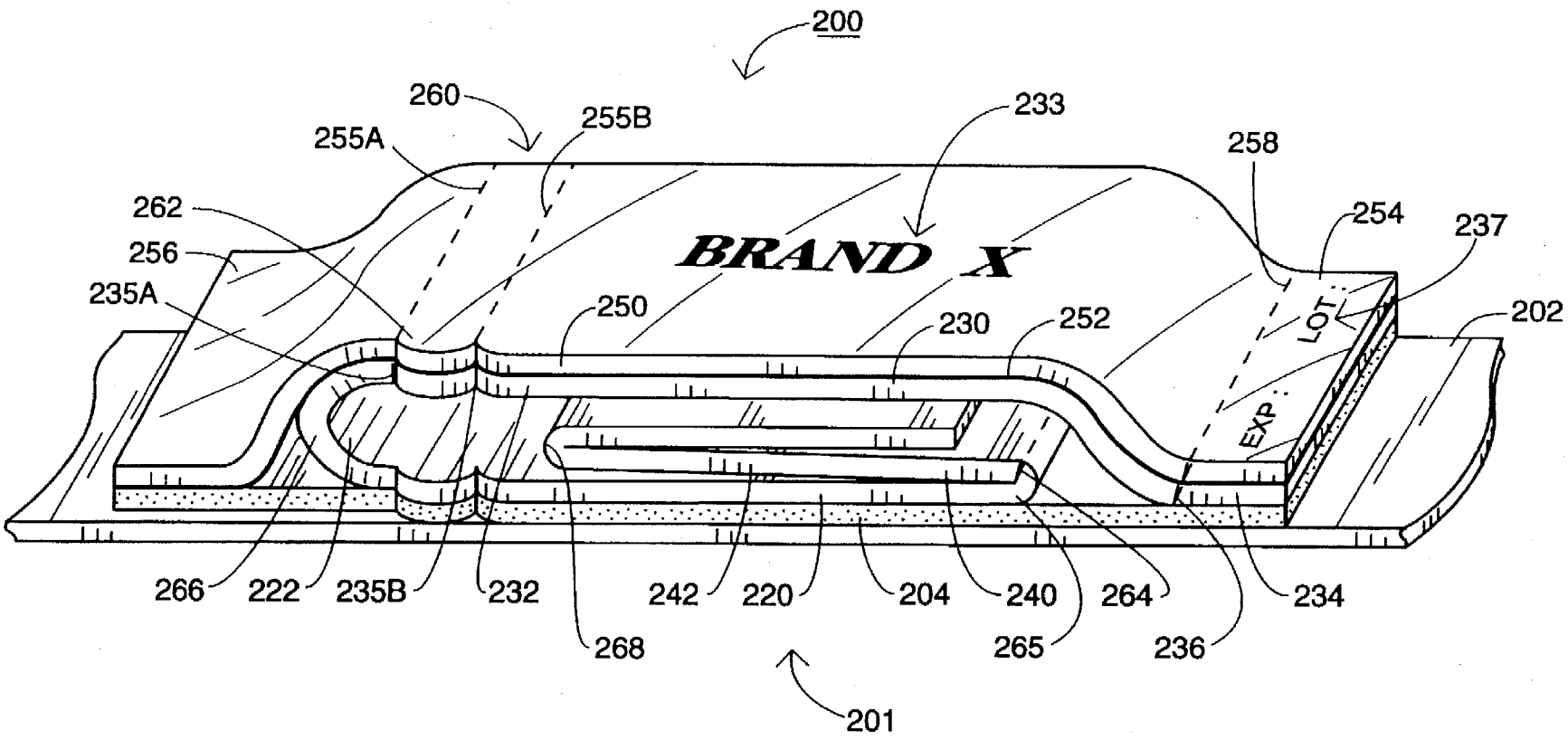
FIG. 4 is a perspective view of a label according to a second embodiment disposed on a release liner.
Figure 5:
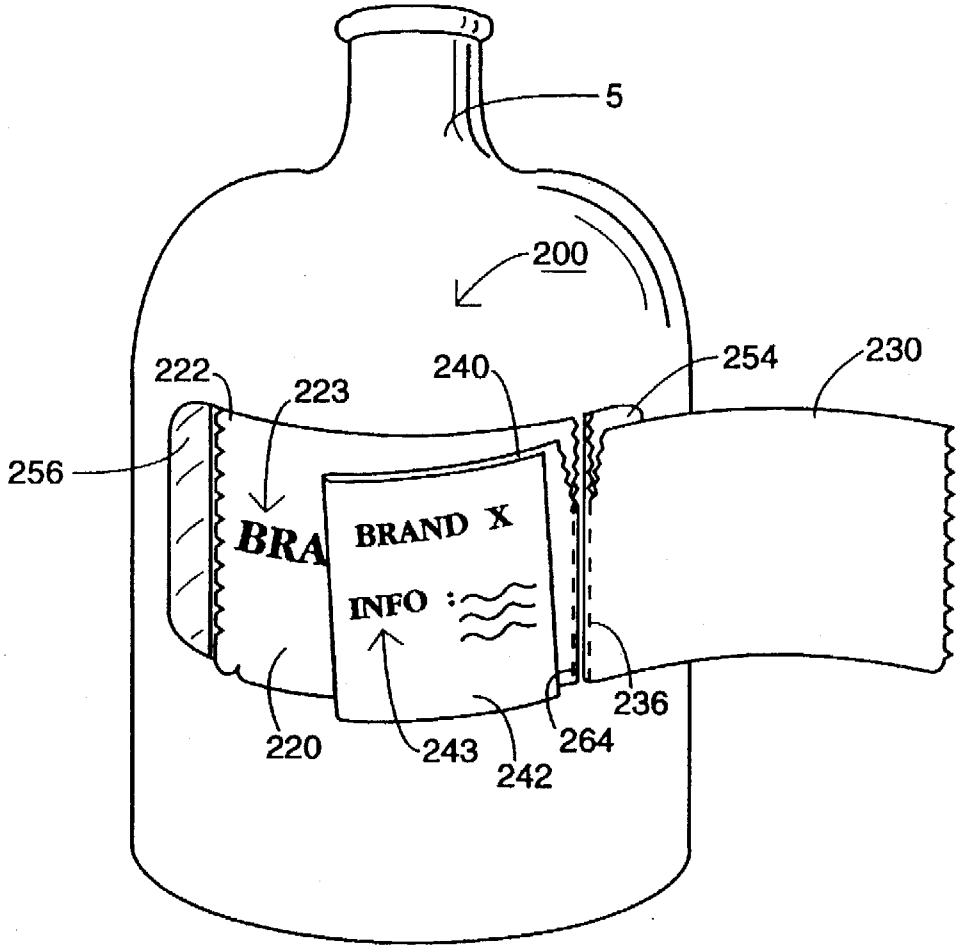
FIG. 5 is a perspective view of the label of the second embodiment secured to a container, the top panel and the first interior panel each partially removed.

With reference to FIGS. 4 and 5, a label according to a second embodiment, generally denoted by the numeral 200 is shown therein. Label 200 includes leaflet 201 and overlying laminate cover 250. Label 200 is releasably secured to release liner 202 by adhesive layer 204. Elements 222, 223, 233, 235A, 235B, 242, 243, 250, 252, 254, 255A, 255B, 256, 260, 262, and 266 of label 200 correspond to elements 122, 123, 133, 135A, 135B, 142, 143, 150, 152, 154, 155A, 155B, 156, 160, 162, and 166, respectively. Label 200 differs from label 100 as follows.

Bottom panel 220 is joined to first interior panel 240 along fold 265. Tear line 264 is formed along fold 265 or, alternatively, in first interior panel 240 adjacent fold 265. Top panel 230 includes marginal extended flap 234 which extends outwardly beyond fold 265 and is coated on its under surface with adhesive 204. Tear line 236 is formed in top panel 230 adjacent fold 265. Tear line 258 is formed in laminate cover 250 and overlies tear line 236. Indicia 237 is disposed on the upper surface of marginal extended flap 234. Marginal portions 222, 232 are defined between fold 266 and adjacent edge 268 of interior panel 240.

With reference to FIG. 5, label 200 is shown therein secured to a suitable container 5. As shown in the figure, tear strip 260 has been removed as discussed above with respect to label 100. Top panel 230 (as well as the overlying portion of laminate cover 250) and first interior panel 240 are shown partially removed. It will be appreciated that the end user is presented with the options of removing top panel 230 by tearing along tear line 236 and tear line 258, removing interior panels 240 and 242 by tearing along tear line 264, or both.

Label 200 may be formed using the same materials as discussed above with respect to label 100. Suitable modifications to the above described apparatus and method for making labels 100 in order to form labels 200 will be apparent to those of ordinary skill in the art upon a reading of the foregoing description.

The above described labels provide several benefits over label designs of the prior art. Tear strips 160, 260 are substantially easier to manipulate than conventional tear lines. It is not necessary for the user to wedge a finger underneath the top panel, but rather he or she need only grasp the tab of the tear strip. Grasping of the tear strip is facilitated by the provision of marginal portions 122, 132 or 222, 232 which provide a gap between end fold 166 or 266 and the interior panels. This gap also allows tear lines 135A, 135B, 155A, and 155B or 235A, 235B, 255A, and 255B to be formed without significant risk of perforating the interior panels in an undesired location.

In the case of label 200, it has been found that adhesive from adhesive layer 204 tends to ooze or migrate into the area of leaflet 201 between fold 265 and the adjacent portion of top panel 230. This adhesive serves to detachably secure fold 265 and/or first interior panel 240 to top panel 230. As a result, when label 200 is removed from release liner 202, leaflet 201 will tend to maintain the configuration shown in FIG. 4. That is, bottom panel 220 will not fall downwardly away from the remainder of the label. This is particularly important when the label is being applied to containers using automatic dispensing equipment.

The laminate covers 150, 250 provide particular benefits to the respective labels. The laminate covers serve to protect the labels from scuffing and tearing, for example, when the containers bearing the labels are packed and unpacked. The laminate covers allow the leaflets to be formed from a material such as paper stock which is desirable for manufacturing ease and consumer appeal, while providing the integrity provided by a film material. The enhanced integrity is beneficial both in applying the labels to containers and in providing a durable and consistent product on the container.

The laminate covers significantly aid in holding the respective labels closed until it is desired to open them. The labels incorporating laminate covers may be modified to provide resealable labels. In particular, the leaflet of label 100 may be formed from a suitable film, such as 3 mil to 7.5 mil Valeron face stock available from Vanlear Flexibles Incorporated of Houston, Tex., and/or the upper surface of marginal extended flap 124 may be coated with a varnish coating such as product no. L075 available from Paragon Inks, Ltd. of Boxburn, Scotland. The materials and adhesive 152 are chosen such that portions 154 and 124 are releasably and resealably adhered. Tear line 158 would not be needed and tear strip 160 could be replaced with a single tear line in each of laminate cover 150 and top panel 130 because initial access to the interior panels would be provided by the resealable flaps.

Figure 7:
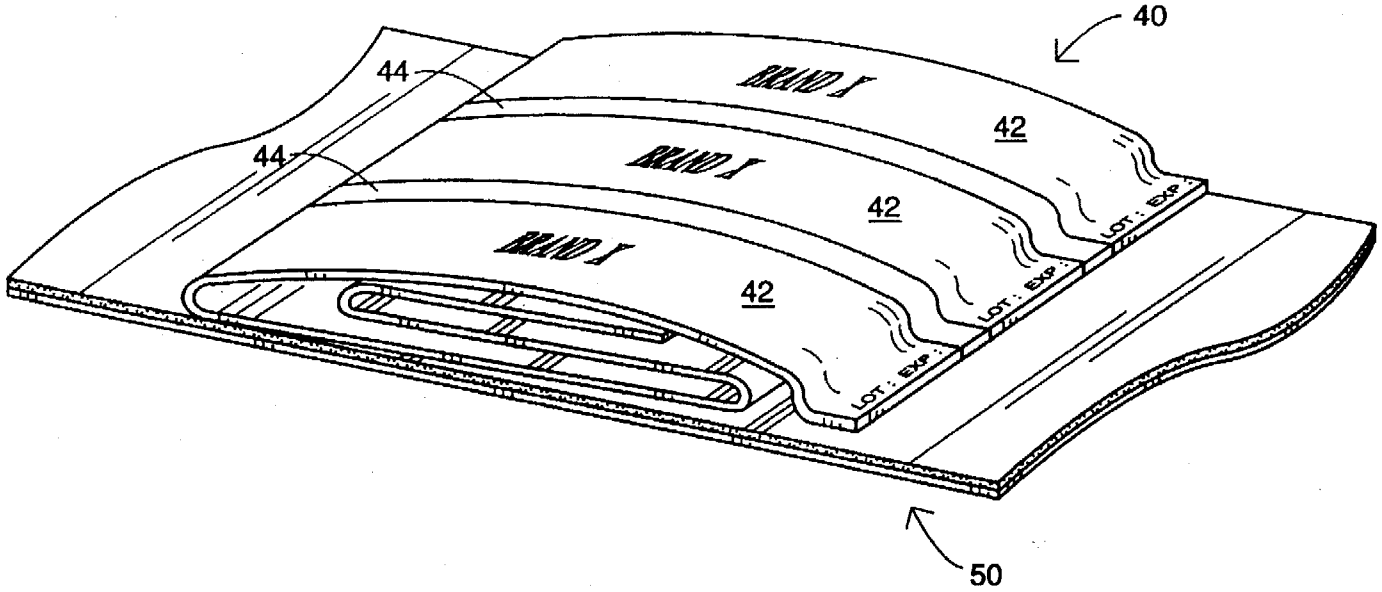
FIG. 7 is a perspective view of a multiple up book for forming labels according to the second embodiment disposed on a web of transfer tape.

The laminate covers 150, 250 allow the respective labels to be formed from "multiple up" books. For example, a multiple up book 40 as shown in FIG. 7 may be used to form labels 200 according to the second embodiment. Multiple up book 40 is a unitary leaflet which is printed with appropriate indicia for multiple leaflets (as shown, three) 42 each corresponding to a leaflet 201. Interposed between respective portions 42 are waste sections 44. Typically, the margins or waste sections 44 are about ½ inch wide.

Multiple up book 40 is shown in FIG. 7 disposed on transfer tape web 50. A laminate web is applied over web 50 and multiple up books 40 as discussed above with regard to FIG. 6. The laminate web and each multiple up book are substantially cut into multiple labels 200 which extend across the transfer tape web. Once the multiple up book 40 is so die cut, waste sections 44 defined between the cut lines forming the respective labels must be removed along with the other waste matrix materials. Because the self adhesive laminate web is provided, waste sections 44 will be removed along with the other waste matrix without further provision because of the integrity and continuity of the laminate material. The transfer tape web may or may not thereafter be slit into individual webs.

As shown in the figures, the portions of labels 100, 200 to the left of the respective tear lines 135A and 235A are stepped back as compared with the remainders of the labels. That is, the width of the given label is less at portions 156, 256 than throughout the remaining length of the label, except adjacent tear lines 135B, 235B where the side edge of the respective label again cuts inwardly to form the tab 162 or 262. The end of the respective tab preferably extends outwardly (widthwise) as far as the adjacent side edge of the body of the label construction of the labels. Construction of the labels in this manner allows for easy access and manipulation of the pull tabs 162, 262 by the end user without requiring an additional step in manufacture. Preferably, the portions to the left of the tear strips have a width (i.e., as measured across the web) which is from about 8 to about 12 percent less than the length of the tear strip (including the tab) and the width of the label at its central portion. Preferably the side edge is cut inwardly at tear line 135B or 235B the same amount. Further, the tabs may be formed at either the top or bottom sides of the labels.

It will be appreciated that the tear strips may be provided on the right sides of the labels. This may be accomplished by rotating the labels 180° and reorienting the indicia appropriately. Further, the tear strip and tabs may be configured to be pulled upwardly or downwardly as desired.

Leaflets 101, 201 may be formed and printed in any suitable manner, such methods and apparatus being known to those of ordinary skill in the art. In particular, both the upper and lower surfaces of each panel may be printed on, including the lower (ultimately adhesive coated) surfaces of the bottom panels. Preferably the adhesive 104, 204 is a clear adhesive so that any indicia disposed on the lower surface of a bottom panel may be viewed through the substrate, for example, the clear glass or plastic of the container to which the label is affixed.

It will be appreciated that labels according to the present invention may be formed without marginal portions in the top and bottom panels. Rather, one or more side edges of the interior panels may extend to or proximate the fold between the top and bottom panels.

It will be appreciated that labels 100, 200 provide the same benefits as provided by U.S. Pat. Nos. 5,207,746 and 5,263,743 to Jones. Namely, because leaflets 101, 201 are formed from a unitary blank, all of the printed components of the labels are unitarily formed. In this way, any risk of mismatching the printed components of the labels (e.g., the inner, instructional panels and the marginal extended flap bearing the lot and expiration information) is eliminated.

While a preferred embodiment of the present invention has been described, it will be appreciated by those of skill in the art that certain modifications may be made without departing from the scope of the present invention. All such modifications are intended to come within the scope of the claims which follow.

What is claimed is:

1. A label for displaying information regarding a package, comprising:

a) a bottom panel having an upper surface and a lower surface;

b) a top panel overlying and connected to said bottom panel along a first fold line;

c) at least one interior panel connected to one of said bottom panel and said top panel along a second fold line, said interior panel having a terminal edge opposite said second fold line mad spaced apart from said first fold line;

d) an adhesive layer disposed on said lower surface of said bottom panel;

e) each of said bottom panel and said top panel having a marginal portion extending between said first fold line and said terminal edge of said interior panel, said marginal portion of said top panel directly overlying said marginal portion of said bottom panel; and f) an access tear line formed in said marginal portion of said top panel and directly overlying said marginal portion of said bottom panel.

2. The label of claim 1 further including a laminate cover having a lower surface and a laminate adhesive coating the substantial entirety of said lower surface, said laminate cover overlying said top panel and secured to said top panel by said laminate adhesive, said laminate cover having a laminate tear line formed therein overlying said access tear line.

3. The label of claim 1 further including a second access tear line formed in said marginal portion of said top panel, said second access tear line directly overlying said marginal portion of said bottom panel and spaced apart from said first access tear line, said first and second access tear lines defining a tear strip therebetween, said tear strip disposed adjacent said first fold line and directly overlying said marginal portion of said bottom panel, and wherein no portion of any said interior panel underlies said tear strip.

4. The label of claim 3 further including a laminate cover having a lower surface and a laminate adhesive coating the substantial entirety of said lower surface, said laminate cover overlying said top panel and secured to said top panel by said laminate adhesive, said laminate cover having first and second laminate tear lines formed therein overlying said first and second access tear lines, respectively.

5. A label for displaying information regarding a package, comprising:

a) a bottom panel having an upper surface and a lower surface;

b) a top panel overlying and connected to said bottom panel along a first fold line;

c) at least one interior panel connected to one of said bottom panel and said top panel along a second fold line, and a marginal extended flap extending outwardly from the other of said bottom panel and said top panel, said marginal extended flap having an upper surface and a lower surface;

d) said interior panel having a terminal edge opposite said second fold line and spaced apart from said first fold line;

e) an adhesive layer disposed on said lower surface of said bottom panel and said lower surface of said marginal extended flap for securing said label to the package, said adhesive layer extending continuously from at least said first fold line to said marginal extended flap;

f) each of said bottom panel and said top panel having a marginal portion extending between said first fold line and said terminal edge of said interior panel, said marginal portion of said top panel directly overlying said marginal portion of said bottom panel;

g) a laminate cover having a lower surface and a laminate adhesive coating the substantial entirety of said lower surface, said laminate cover overlying said top panel and said marginal extended flap and secured to said top panel and said marginal extended flap by said laminate adhesive;

h) first and second access tear lines each formed in said marginal portion of said top panel, each of said first and second access tear lines directly overlying said marginal portion of said bottom panel and spaced apart from one another, said first and second access tear lines defining a tear strip therebetween, said tear strip disposed adjacent said first fold line and directly overlying said marginal portion of said bottom panel, and wherein no portion of any said interior panel underlies said tear strip;

i) first and second laminate tear lines formed in said laminate cover overlying said first and second access tear lines, respectively;

j) a removal tear line adjacent said second fold line; and k) indicia disposed on said upper surface of said marginal extended flap and corresponding indicia disposed on said upper surface of said bottom panel.

6. The label of claim 5 further including a third laminate tear line formed in said laminate cover adjacent said marginal extended flap.

7. The label of claim 5 wherein said laminate cover is releasably and resealably secured to said upper surface of said marginal extended flap by said laminate adhesive.

8. A label for displaying information regarding a package, comprising:

a) a bottom panel having an upper surface and a lower surface;

b) a top panel overlying and connected to said bottom panel along a first fold line;

c) at least one interior panel connected to said top panel along a second fold line, said interior panel having a terminal edge opposite said second fold line and spaced apart from said first fold line;

d) said bottom panel including a marginal extended flap extending beyond said top panel, said marginal extended flap having an upper surface and a lower surface;

e) an adhesive layer disposed on said lower surface of said bottom panel and said lower surface of said marginal extended flap for securing said label to the package;

f) each of said bottom panel and said top panel having a marginal portion extending between said first fold line and said terminal edge of said interior panel, said marginal portion of said top panel directly overlying said marginal portion of said bottom panel;

g) a laminate cover having a lower surface and a laminate adhesive coating the substantial entirety of said lower surface, said laminate cover overlying said top panel and said marginal extended flap and secured to said top panel and said marginal extended flap by said laminate adhesive;

h) an access tear line formed in said marginal portion of said top panel and directly overlying said marginal portion of said bottom panel; and i) a laminate tear line formed in said laminate cover overlying said access tear line.

9. The label of claim 8 further including a second laminate tear line formed in said laminate cover adjacent said marginal extended flap.

10. The label of claim 8 wherein said laminate cover is releasably and resealably secured to said upper surface of said marginal extended flap by said laminate adhesive.

11. The label of claim 8 further including a second access tear line formed in said marginal portion of said top panel, said second access tear line directly overlying said marginal portion of said bottom panel and spaced apart from said first access tear line, said first and second access tear lines defining a tear strip therebetween, said tear strip disposed adjacent said first fold line and directly overlying said marginal portion of said bottom panel, and wherein no portion of any said interior panel underlies said tear strip, and further including a second laminate tear line overlying said second access tear line.

12. The label of claim 8 further including a removal tear line formed in one of said top panel and said interior panel adjacent said second fold line.

13. The label of claim 8 wherein said adhesive layer extends continuously from at least said first fold line to said marginal extended flap.

14. The label of claim 8 further including indicia disposed on said upper surface of said marginal extended flap and corresponding indicia disposed on said upper surface of said bottom panel.

15. A label for displaying information regarding a package, comprising:

a) a bottom panel having an upper surface and a lower surface;

b) a top panel overlying and connected to said bottom panel along a first fold line;

c) at least one interior panel connected to said bottom panel along a second fold line, said interior panel having a terminal edge opposite said second fold line and spaced apart from said first fold line;

d) a marginal extended flap extending outwardly from said top panel, said marginal extended flap having an upper surface and a lower surface;

e) an adhesive layer disposed on said lower surface of said bottom panel and said lower surface of said marginal extended flap for securing said label to the package;

f) each of said bottom panel and said top panel having a marginal portion extending between said first fold line and said terminal edge of said interior panel, said marginal portion of said top panel directly overlying said marginal portion of said bottom panel;

g) a laminate cover having a lower surface and a laminate adhesive coating the substantial entirety of said lower surface, said laminate cover overlying said top panel and said marginal extended flap and secured to said top panel and said marginal extended flap by said laminate adhesive;

h) an access tear line formed in said marginal portion of said top panel and directly overlying said marginal portion of said bottom panel; and i) a laminate tear line formed in said laminate cover overlying said access tear line.

16. The label of claim 15 further including a removal tear line formed in said top panel adjacent said marginal extended flap and said second fold line, and a second laminate tear line formed in said laminate cover and overlying said removal tear line.

17. The label of claim 15 further including a second access tear line formed in said marginal portion of said top panel, said second access tear line directly overlying said marginal portion of said bottom panel and spaced apart from said first access tear line, said first and second access tear lines defining a tear strip therebetween, said tear strip disposed adjacent said first fold line and directly overlying said marginal portion of said bottom panel, and wherein no portion of any said interior panel underlies said tear strip, and further including a second laminate tear line overlying said second access tear line.

18. The label of claim 15 wherein said adhesive layer extends continuously from at least said first fold line to said marginal extended flap.

19. The label of claim 15 further including indicia disposed on said upper surface of said marginal extended flap and corresponding indicia disposed on said upper surface of said bottom panel.

20. A label for displaying information regarding a package, comprising:

a) a bottom panel having an upper surface and a lower surface;

b) a top panel overlying and connected to said bottom panel along a first fold line;

c) at least one interior panel connected to said top panel along a second fold line;

d) said bottom panel including a marginal extended flap extending beyond said top panel, said marginal extended flap having an upper surface and a lower surface;

e) an adhesive layer disposed on said lower surface of said bottom panel and said lower surface of said marginal extended flap for securing said label to the package;

f) a laminate cover having a lower surface and a laminate adhesive coating the substantial entirety of said lower surface, said laminate cover overlying said top panel and said marginal extended flap and secured to said top panel and said marginal extended flap by said laminate adhesive;

g) a first access tear line formed in said top panel adjacent said first fold line;

h) a second access tear line formed in said top panel and spaced apart from said first access tear line, said first and second access tear lines defining a tear strip therebetween, said tear strip disposed adjacent said first fold line; and i) first and second laminate tear lines formed in said laminate cover overlying said first and second access tear lines, respectively.

21. The label of claim 20 further including a third laminate tear line formed in said laminate cover adjacent said marginal extended flap.

22. The label of claim 20 wherein said laminate cover is releasably and resealably secured to said upper surface of said marginal extended flap by said laminate adhesive.

23. The label of claim 20 further including a removal tear line formed in one of said top panel and said interior panel adjacent said second fold line.

24. The label of claim 20 wherein said adhesive layer extends continuously from at least said first fold line to said marginal extended flap.

25. The label of claim 20 further including indicia disposed on said upper surface of said marginal extended flap and corresponding indicia disposed on said upper surface of said bottom panel.

26. A label for displaying information regarding a package, comprising:

a) a bottom panel having an upper surface and a lower surface;

b) a top panel overlying and connected to said bottom panel along a first fold line;

c) at least one interior panel connected to said bottom panel along a second fold line;

d) a marginal extended flap extending outwardly from said top panel, said marginal extended flap having an upper surface and a lower surface;

e) an adhesive layer disposed on said lower surface of said bottom panel and said lower surface of said marginal extended flap for securing said label to the package;

f) a laminate cover having a lower surface and a laminate adhesive coating the substantial entirety of said lower surface, said laminate cover overlying said top panel and said marginal extended flap and secured to said top panel and said marginal extended flap by said laminate adhesive;

g) a first access tear line formed in said top panel adjacent said first fold line;

h) a second access tear line formed in said top panel and spaced apart from said first access tear line, said first and second access tear lines defining a tear strip therebetween, said tear strip disposed adjacent said first fold line: and i) first and second laminate tear lines formed in said laminate cover overlying said first and second access tear lines, respectively.

27. The label of claim 26 further including a removal tear line formed in said top panel adjacent said marginal extended flap and said second fold line, and a third laminate tear line formed in said laminate cover and overlying said removal tear line.

28. The label of claim 26 wherein said adhesive layer extends continuously from at least said first fold line to said marginal extended flap.

29. The label of claim 26 further including indicia disposed on said upper surface of said marginal extended flap and corresponding indicia disposed on said upper surface of said bottom panel.

30. The label of claim 1 wherein said marginal portions of said top and bottom panels have a width extending between said terminal edge of said interior panel to said first fold line of from about 0.1875 to 0.25 inch.

31. The label of claim 5 wherein said marginal portions of said top and bottom panels have a width extending between said terminal edge of said interior panel to said first fold line of from about 0.1875 to 0.25 inch.

32. The label of claim 8 wherein said marginal portions of said top and bottom panels have a width extending between said terminal edge of said interior panel to said first fold line of from about 0.1875 to 0.25 inch.

33. The label of claim 15 wherein said marginal portions of said top and bottom panels have a width extending between said terminal edge of said interior panel to said first fold line of from about 0.1875 to 0.25 inch.

* * * * *